US006553673B2

(12) United States Patent
Peyrot et al.

(10) Patent No.: US 6,553,673 B2
(45) Date of Patent: Apr. 29, 2003

(54) KNIFE WITH AUTOMATICALLY RETRACTABLE BLADE

(75) Inventors: Jean-Claude Peyrot, Bordeaux (FR); Marc Michiels, Salies de Bearn (FR)

(73) Assignee: Mure & Peyrot, Societe a Responsabilite Limitee, Bordeaux (FR)

( * ) Notice: Subject to any disclaimer, the term of this patent is extended or adjusted under 35 U.S.C. 154(b) by 0 days.

(21) Appl. No.: 09/891,260

(22) Filed: Jun. 27, 2001

(65) Prior Publication Data

US 2002/0029482 A1 Mar. 14, 2002

(30) Foreign Application Priority Data

Jun. 27, 2000 (FR) ..... 00 08232

(51) Int. Cl.[7] ..... B26B 1/10
(52) U.S. Cl. ..... 30/162
(58) Field of Search ..... 30/162, 163, 2, 30/335, 336

(56) References Cited

U.S. PATENT DOCUMENTS 4,761,882 A 8/1988 Silverstein ..... 30/162
5,203,085 A * 4/1993 Berns ..... 30/162
5,581,890 A * 12/1996 Schmidt ..... 30/2 X
5,617,635 A 4/1997 Berns ..... 30/162
6,044,562 A 4/2000 Dillenbeck ..... 30/162
6,249,975 B1 * 6/2001 Lin ..... 30/162
6,314,646 B1 * 11/2001 Schmidt ..... 30/162

FOREIGN PATENT DOCUMENTS

DE 43 15 495 11/1994
EP 0 882 553 12/1998

* cited by examiner

*Primary Examiner*—Douglas D. Watts
(74) *Attorney, Agent, or Firm*—Young & Thompson

(57) ABSTRACT

A knife includes a casing and a blade which can have two positions, an extended position in which the blade projects outside the casing and a retracted position in which the blade is disposed within the casing, a blade carrier to which is connected the blade, a housing on which is slidably mounted the blade carrier and that is removably mounted within the casing, and a finger piece-pusher mounted slidably on the casing to move forwardly the blade carrier to place the blade in a cutting position. The blade carrier and finger piece-pusher are returned to the retracted position by return springs. Components are provided to secure the finger piece-pusher and the blade carrier together to place the blade in the extended position. The components are uncoupled by a conjoint action of rotation and extraction of the blade carrier relative to the finger piece-pusher, resulting from the cutting action.

3 Claims, 3 Drawing Sheets

KNIFE WITH AUTOMATICALLY RETRACTABLE BLADE

BACKGROUND OF THE INVENTION

The present invention has for its object a knife provided with a blade which can automatically retract as soon as said blade is no longer in contact with the object to be cut.

A knife generally comprises a casing in which a blade can slide, fixed to a blade carrier, which can have two positions, a first so-called extended position, in which the blade projects outside the casing, and a second so-called retracted position, in which the blade is disposed integrally within the casing.

In a simple modification, the blade carrier moves in a slideway provided in the casing, and comprises notches which permit holding said blade carrier, and hence the blade, in a predetermined position.

This modification is not satisfactory from a standpoint of safety, because the blade remains in the extended position, risking causing harm, if the user does not think to retract it after use.

A first improvement consists in providing at the level of the blade carrier return means to the retracted position. In this case, the blade carrier comprises a finger piece adapted to be moved by the thumb of the user so as to cause the blade to extend or to hold the blade in extended position. Thus, as soon as the user releases the finger piece, the return means automatically return the blade to the retracted position.

Even if this improved version provides greater safety than the simple version, it remains no less dangerous at the time of the end of cutting, the instant when the greatest number of accidents occur.

Thus, to cut an object with a knife, the user must exert a relatively great force in the direction of the object to be cut, and give a cutting movement to the knife directed toward himself. Also, at the end of cutting, at the time at which the knife ceases to be in contact with the object, control of the knife can escape the user, so that the knife, and more particularly the blade, can come into contact with a portion of the body of the user and cut him, unless he has had the reflex to release the finger piece so that the blade retracts.

SUMMARY OF THE INVENTION

The present invention seeks to overcome the drawbacks of knives of the prior art by providing a reliable and secure knife, provided with a blade which retracts automatically as soon as said blade is no longer in contact with the object to be cut.

To this end, the invention has for its object a knife comprising a casing and a blade which can have two positions, a first so-called extended position, in which the blade projects outside the casing, and a second so-called retracted position, in which the blade is disposed integrally within the casing, characterized in that it comprises a blade carrier to which is connected the blade, a housing on which is slidably mounted said blade carrier removably mounted within the casing, and a finger piece-pusher mounted slidably on the casing so as to move said blade carrier forwardly thereby to place the blade in the cutting position, said blade carrier and finger piece-pusher being returned to the retracted or rest position, by return springs, and in that means are provided to secure the finger piece-pusher and the blade carrier together to place the blade in said first position, said means being uncoupled by the conjoint action of rotation and extraction of the blade carrier relative to the finger piece-pusher, following the cutting action.

According to one embodiment, said disconnectable means are constituted by a drive finger secured to said finger piece-pusher, whose end is provided with a notch for receiving a projection secured to the blade carrier, said notch and projection being laterally offset in the rest or retracted position of the finger piece and the blade carrier, placed in alignment and in engagement upon the beginning of movement of the finger piece-pusher and uncoupled as soon as the blade is in the course of cutting, such that said notch will no longer be on the return path of the projection during retraction of the blade carrier.

There is thus obtained a knife with a truly safe retractable blade in the sense that the blade is already placed in automatic retraction position, as soon as traction is exerted on the knife to carry out a cut, the retraction taking place automatically as soon as the blade leaves or escapes from the object or element which has been cut, without having to exert any action on the finger piece-pusher.

BRIEF DESCRIPTION OF THE DRAWINGS

Other characteristics and advantages will become apparent from the description which follows, of an embodiment of a cutter according to the invention, which description is given by way of example only and with respect to the accompanying drawings, in which.

DESCRIPTION OF THE PREFERRED EMBODIMENTS

Figure 1:
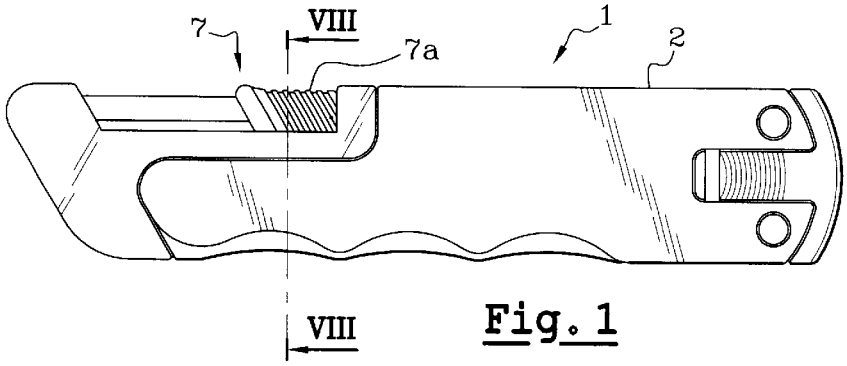
FIG. 1 is a side elevational view of a knife according to the invention.

In the drawings, there is shown at numeral 1 a knife comprising a casing 2 forming a sleeve of generally substantially elliptical cross-section, within which is disposed a housing 3 carrying, on the one hand, a blade carrier 4 and, on the other hand, a blade 6 of conventionally trapezoidal shape.

Figure 13:
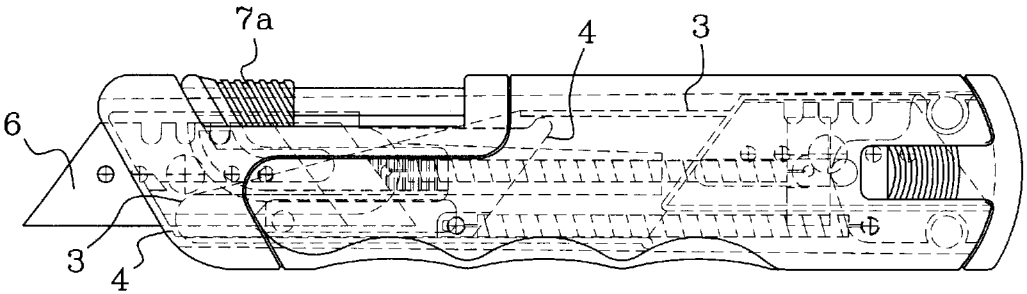
Figure 14:
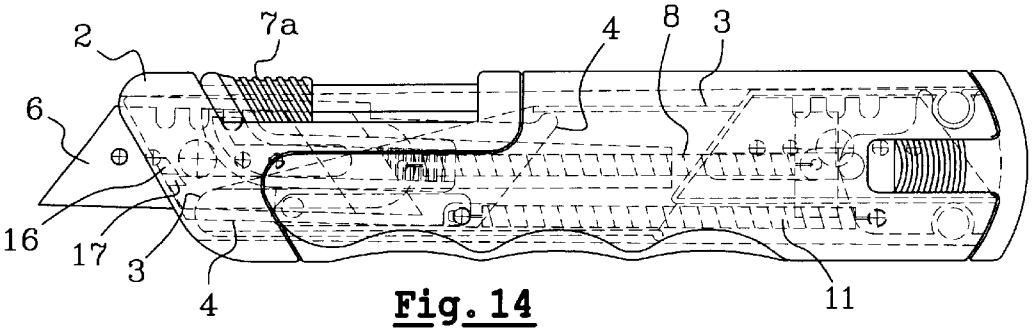

The blade carrier 4 is slidably mounted in the housing 3 at the front of this latter at the distal portion of the casing 2 which is open at its end to provide a passage, through a rectangular slot, of the end of the blade 6 carried by the blade carrier 4, when the knife is in the cutting position (FIGS. 13, 14).

Figure 9:
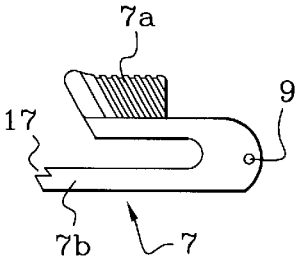
FIG. 9 is a side elevational view of the finger piece-pusher.
Figure 8:
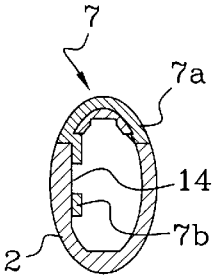
FIG. 8 is a cross-sectional view on the line VIII—VIII of FIGS. 1 and 2 without the assembly of housing and blade carrier.
Figure 10:
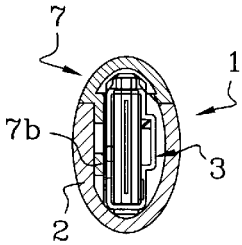
FIG. 10 is a cross-sectional view on the line VIII—VIII of FIG. 1 with the assembly of the housing and blade carrier.

The blade carrier 4 is moved with the help of a finger piece-pusher 7 comprising (FIG. 9) a finger piece 7*a* slidably mounted on the casing 2 in its front half portion and a drive finger 7*b* directed forwardly of the knife and arranged (FIGS. 8 and 10) between one of the flanks of the assembly of the housing 3 and blade carrier 4 and the internal flank facing the casing 2.

Figure 2:
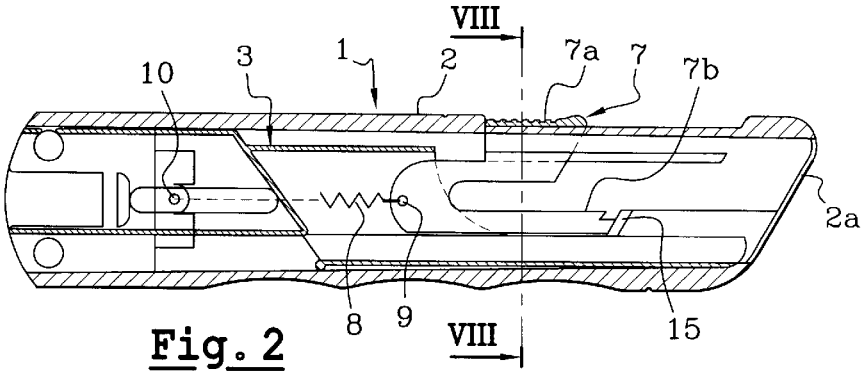
FIG. 2 is a cross-sectional view on a median plane containing the longitudinal axis of the knife of FIG. 1.

The finger piece 7 is returned to its rest position (FIGS. 1, 2, 11) by a spring 8 anchored at 9 on the finger piece 7 and at 10 on the housing 3.

Figure 3:
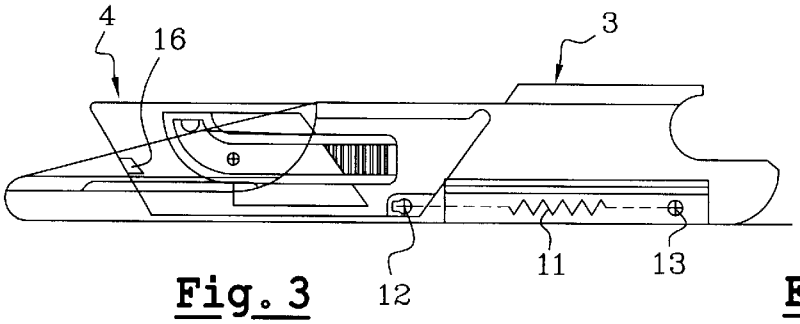
FIG. 3 is a side elevational view of the housing with the blade carrier of the knife.
Figure 4:
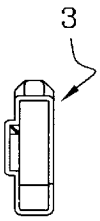
FIG. 4 is a left side view of the housing of FIG. 3.
Figure 11:
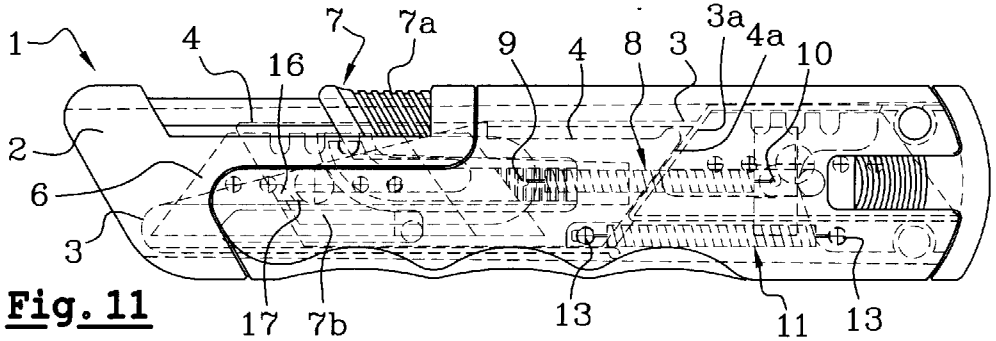
FIGS. 11 to 16 show different positions of the movable elements of the knife in the course of use.
Figure 12:
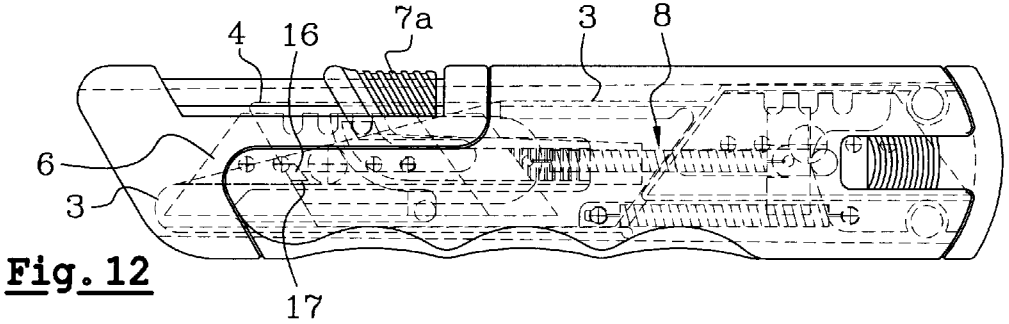

The blade carrier 4 is returned to its rest position shown in FIGS. 3 and 11 by a spring 11 anchored at 12 on the blade carrier 4 and at 13 on the housing 3.

Figure 5:
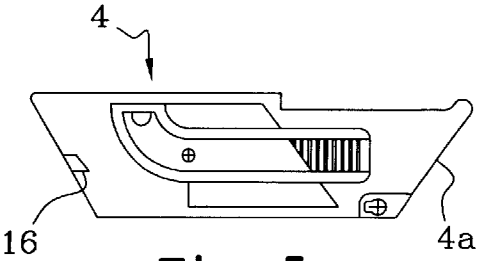
FIG. 5 is a side elevational view of the blade carrier of FIG. 3.
Figure 6:
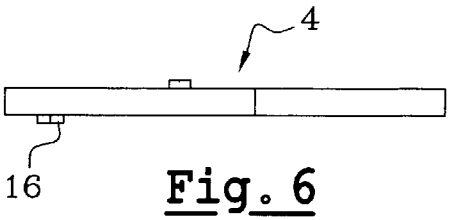
FIG. 6 is a top plan view of the blade carrier.
Figure 7:
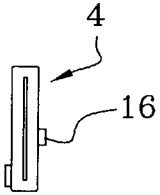
FIG. 7 is a view from the left of the blade carrier.

The drive finger 7*b* slides along a flat internal surface 14 of the casing and encounters, practically as soon as the finger piece 7*a* leaves its rest position when it is pressed forwardly, a small inclined ramp 15 (FIG. 2) which deflects laterally the end of the finger 7*b* inwardly of the casing 2 in the direction of a projection 16 (FIGS. 5 and 7) provided laterally of the blade carrier 4.

More precisely, as shown particularly in FIGS. 5, 9, 11 and 12, the finger 7*b* is provided with a notch 17 of a shape corresponding to said projection 16.

At rest (FIG. 11), the end of the finger 7*b* is laterally offset relative to the projection 16 and slightly retracted relative to this latter.

As soon as the finger piece 7*a* begins to be moved forwardly (FIG. 12) the end of the finger 7*b* is deflected in the direction of the blade carrier 4 such that the notch 17 receives the projection 16. The blade carrier 4 is thus subjected to the finger 7*b* and is pressed forwardly of the knife 1 by the finger piece 7*a* which follows its path (FIG. 13) to the end. The pressure must be maintained on the finger piece 7*a* because the two return springs 8 and 11 are thus stressed. The nose of the blade carrier 4 is in abutment against a peripheral flange 2*a* (FIG. 2) of the casing 2 and the blade 6 projects at the end of the knife, ready for use.

Figure 15:
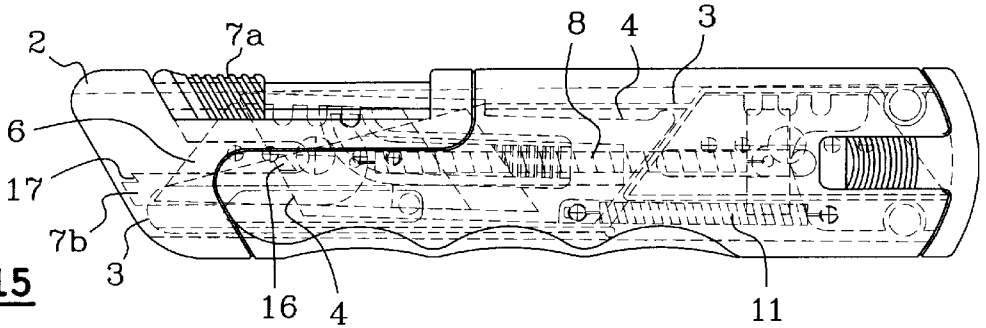

When the blade 6 is in action (FIG. 14), the traction exerted on the blade following the cutting action causes the blade carrier 4 to swing slightly within the casing 2 while the blade 6 projects slightly more, which has the effect of disengaging the projection 16 from the notch 17. Thus, as soon as the cutter is disengaged from the cut, the finger piece 7*a* being still in place at the end of its extension movement, the blade carrier 4, continuously urged backwardly by the spring 11, misses the notch 17 that would retain it and is automatically returned (FIG. 15) by said spring 11 to the rest position of FIG. 11.

Through retraction of the blade 6 completely within the casing 2 thus takes place automatically, without having to act on the finger piece 7*a* and, this happens as soon as traction on the blade 6 is no longer exerted to cut the element or object.

It is to be noted that when the cutter is in the position of FIG. 13 in which the blade 6 is extended, a simple pressure of this latter on the object or element to be cut will not disengage the projection 16 from the notch 17.

What is necessary is a cutting action applying a traction on the housing 2 whilst the blade 6 is retained pinched between the edges of the cut, to give rise to the conjoint action of slight swinging of the blade 6—blade carrier 4 assembly within the casing 2, the necessary play being provided for this purpose, and the slight supplemental withdrawal of said assembly outside the casing, this conjoint action giving rise to said disengagement and the positioning of the notch 17 outside the return path of the projection 16, which is to say of the blade carrier 4.

Figure 16:
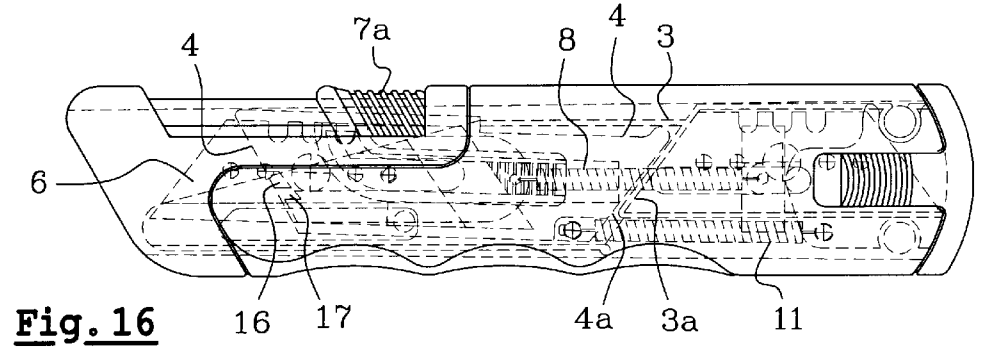

By releasing the finger piece 7*a* (FIG. 16) this latter is automatically returned by the spring 8 to the rest position of FIG. 11.

The blade carrier 4 is returned to the position at the same height of the projection 16 and the notch 17 by return swinging caused by the inclined wall 3*a* of the housing 3 which acts to straighten out the rear edge 4*a* of the blade carrier 4.

Finally, the invention is evidently not limited to the embodiment shown and described above but on the contrary covers all modifications, particularly as to the forward drive means of the blade carrier by the finger piece, these means being disengaged when the blade undergoes traction, which is to say during the cutting action.

We claim:

1. A knife comprising:

a casing (2) and a blade (6) which can have two positions, an extended position in which the blade (6) projects outside the casing (2) and a retracted position in which the blade (6) is disposed integrally within the casing (2);

a blade carrier (4) to which is connected the blade (6);

a housing (3) on which is slidably mounted said blade carrier (4) that is removably mounted within the casing (2);

a finger piece-pusher (7) slidably mounted on the casing so as to move forwardly said blade carrier (4) so as to place the blade in a cutting position;

return springs (8, 11) for returning said blade carrier (4) and finger piece-pusher (7) to the retracted position; and disconnectable means (7*b*, 16, 17) for securing the finger piece-pusher (7) and the blade carrier (4) together to place the blade in the extended position, said disconnectable means being uncoupled by conjoint action of rotation and extraction of the blade carrier (4) relative to the finger piece-pusher (7), following a cutting action.

2. The knife according to claim 1, wherein said disconnectable means comprise a drive finger (7*b*) secured to said finger piece-pusher (7), an end of said drive finger being provided with a notch (17) that receives a projection (16) secured to the blade carrier (4), said notch (17) and said projection (16) being offset laterally in the retracted position of the finger piece (7) and blade carrier (4), placed in alignment and in engagement at a beginning of movement of the finger piece-pusher (7), and uncoupled as soon as the blade (6) is performing a cutting action, such that said notch (17) is no longer in a return path of the projection (16) during retraction of the blade carrier (4).

3. The knife according to claim 2, wherein said end-of the drive finger (7*b*) is shifted laterally by a small ramp (15) provided on the internal wall of the casing (2).

* * * * *